US005820096A

United States Patent [19]

Lynch et al.

[11] Patent Number: 5,820,096

[45] Date of Patent: Oct. 13, 1998

[54] ADJUSTABLE KINETIC STABILIZATION INSTRUMENT

[76] Inventors: James M. Lynch, 10200 Breckenridge Ave., St. Ann, Mo. 63074; Teresa A. Lynch, P.O. Box 10457, Jackson, Wyo. 83001; James R. Moe, 2419 Mayer Dr., St. Charles, Mo. 63301

[21] Appl. No.: 959,186

[22] Filed: Oct. 28, 1997

[51] Int. Cl.[6] ..... A47B 91/00

[52] U.S. Cl. ..... 248/346.01; 601/27

[58] Field of Search ..... 248/143, 144, 248/318, 346.01, 346.06; 601/23, 31

[56] References Cited

U.S. PATENT DOCUMENTS

| | | | |
|---|---|---|---|
| 3,136,522 | 6/1964 | Calderone | 248/318 |
| 4,183,521 | 1/1980 | Kroeker . | |
| 4,505,477 | 3/1985 | Wilkinson . | |
| 4,613,131 | 9/1986 | Anderson . | |
| 4,618,145 | 10/1986 | Inada . | |
| 4,619,462 | 10/1986 | Shaffer et al. | 280/242.1 |
| 4,736,205 | 4/1988 | Dodge | 340/985 |
| 4,801,140 | 1/1989 | Bergeron . | |
| 5,048,823 | 9/1991 | Bean . | |
| 5,112,045 | 5/1992 | Mason et al. . | |
| 5,512,912 | 4/1996 | Ross et al. | 343/765 |
| 5,536,226 | 7/1996 | Gordon . | |
| 5,547,460 | 8/1996 | Ishikawa . | |
| 5,549,536 | 8/1996 | Clark . | |
| 5,582,567 | 12/1996 | Chang . | |
| 5,671,990 | 9/1997 | Teasdale | 248/318 |

*Primary Examiner*—Ramon O. Ramirez
*Assistant Examiner*—Robert Lipcsik
*Attorney, Agent, or Firm*—Kevin L. Klug

[57] ABSTRACT

An adjustable kinetic stabilization instrument having a balance platform which provides rotational and linear movement in two axis versus a shift in center of gravity relative to its geometric center. The adjustable kinetic stabilization instrument is used by physical therapists and physical trainers to help improve or revive a person's sense of kinesthesia when a person stands on the platform. The adjustable kinetic stabilization instrument has a plurality of eyelets into which the pivotable pedestal supports may be placed in order to make the platform more or less sensitive to the center of gravity offset caused by the person using the instrument.

8 Claims, 7 Drawing Sheets

ADJUSTABLE KINETIC STABILIZATION INSTRUMENT

BACKGROUND OF THE INVENTION

The present invention relates in general to balance platforms and devices for maintaining balance stability and pertains, more particularly, to a balance platform instrument which has an easily adjustable but limited range of motion in two axes. The adjustable kinetic stabilization instrument of this invention is an improvement over conventional balance platforms or stabilization devices.

With conventional balance platforms, support is generally provided from below the platform surface via rotating ball joints, rocking arms or semi-spherical supports. These prior art methods of support often create an inherently unstable platform which must contain stop mechanisms to safely limit its useful range of movement. The added complexity of the stop mechanisms increase cost and limit reliability and safety of such devices. Although some balance platform designs are available which provide for support from above the surface of the platform, these designs limit the two axis movement of the platform and generally do not provide for two axis movement adjustability. The limitation of such devices make them of limited use to the physical therapist, physical trainer or person using such devices.

Accordingly, it is an object of the present invention to provide an improved balance platform with an adjustable range of motion in two axis that is inherently stable, easy to adjust, and able to provide a wide range of motion by amplifying the movement due to the center of gravity offset of the user.

Another object of the present invention is to provide an improved balance platform which provides an adjustable wide range of stable motion with inherent limitations in its maximum angle of motion in all axis.

A further object of the present invention is to provide an improved balance platform which is manufacturable in a cost effective manner and yet safe and easy to use.

SUMMARY OF THE INVENTION

To accomplish the foregoing and other objects of this invention there is provided a adjustable kinetic stabilization instrument having a balance platform with an adjustable range of motion which is comprised of a platform, a platform support pedestal, a pedestal base plate, four or more pivotable pedestal supports and a frame with sidewalls. The platform upon which the user stands is attached to the topside of the pedestal and the pedestal bottomside is attached to the pedestal base plate. In a preferred embodiment, mounted onto the pedestal base plate are four support attachment brackets each containing one or more support structure eyelets. The support structure eyelets provide attachment points for the pivotabale pedestal supports. In a preferred embodiment the pivotable pedestal supports are manufactured of metal chains. The pivotable pedestal supports could also be manufactured of pivotable rigid material such as steel or aluminum rod. In a preferred embodiment the pivotable pedestal supports are mounted onto the frame with frame support pins, preferable in each of the four corners of the rectangular top opening. Furthermore, in the preferred embodiment, each pivotable pedestal support contains a snap link which allows easy attachment and removal from the selected support structure eyelets. Alternative embodiments may incorporate hooks or other types of fasteners for attachment to the support structure eyelets.

For many years physical therapists and physical trainers have used balance type platforms to help persons develop or revive their kinesthetic abilities. That is, the sense by which a person senses and perceives position, weight and movement. The balance platform is generally a flat platform which has an angular and/or a linear movement which is related, although not necessarily proportional, to the offset of a person's center of gravity relative to the center of the platform. It generally has a partial rotation in two axes, that is front and rear and left and right relative to the person using the device. Past designs incorporated support mechanisms below the platform which are inherently unstable, do not provide the required angular movement of the platform versus the shift of center of gravity of the user, or are difficult to manufacture. That is, the prior art generally represents devices which are safety concerns, cost concerns, or offer limited movement and adjustment of movement versus user center of gravity offset.

In the preferred embodiment of the present invention, the safety, limited movement and cost issues of the prior art are addressed. That is, the fact that the platform is offset in height with a platform support pedestal relative to the pedestal base plate causes an amplification of the rotational movement of the platform relative to the center of gravity offset of the person using the device. Without the platform support pedestal, the rotational movement of the platform relative to the center of gravity offset of the user is minimal. Furthermore, the fact that the platform is offset relative to the pedestal base plate, allows the user to adjust the relative linear and rotational movement versus center of gravity offset by placing the appropriate snap links in the eyelets of their choosing. As the snaplinks are placed closer toward the center of the pedestal base plate, the pedestal becomes more sensitive to a center of gravity offset and reflects this in more rotational and linear movement versus center of gravity offset.

The safety issue is addressed in two ways. First, the side walls of the frame limit the front, back, right and left linear movement and also provide a stop on the rotational movement. secondly, when supported via the pivotable pedestal supports as shown, the linear movement reaches a limit when the user's center of gravity aligns with the pivoting point of the pivotable pedestal supports where the frame support pins hold said supports. This limits the pedestal to only rotational movement at this point. This rotational movement is then limited by the pedestal resting upon the sidewalls.

The adjustable kinetic stabilization instrument can be manufactured of different materials and in different sizes and colors. In the preferred embodiment described herein the adjustable kinetic stabilization instrument is comprised of metallic plate and structural material but could be manufactured of wood, plastic, composites or any other structural material capable of holding human weight. Furthermore, the modest number of components required for construction of the adjustable kinetic stabilization instrument as compared to prior art devices, helps to limit the cost.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
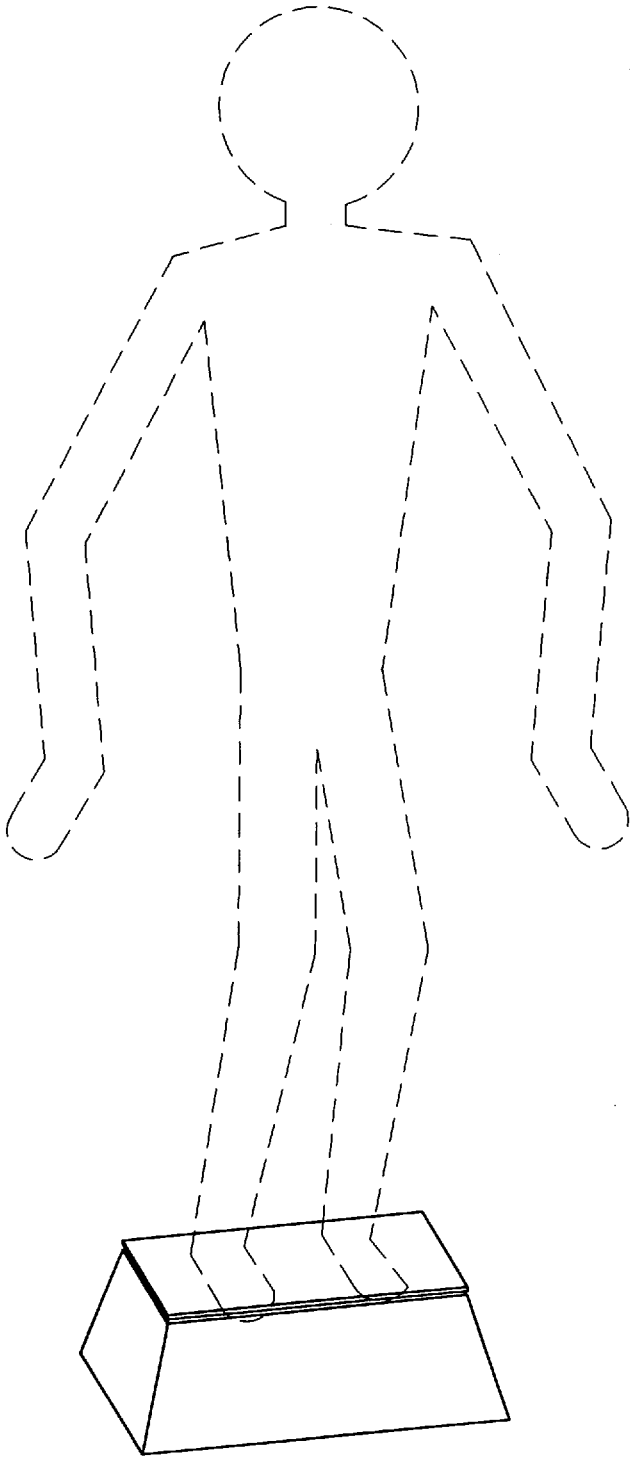
FIG. 1 is a perspective view of a preferred embodiment of the adjustable kinetic stabilization instrument with an outline of a person standing on the device.
Figure 2:
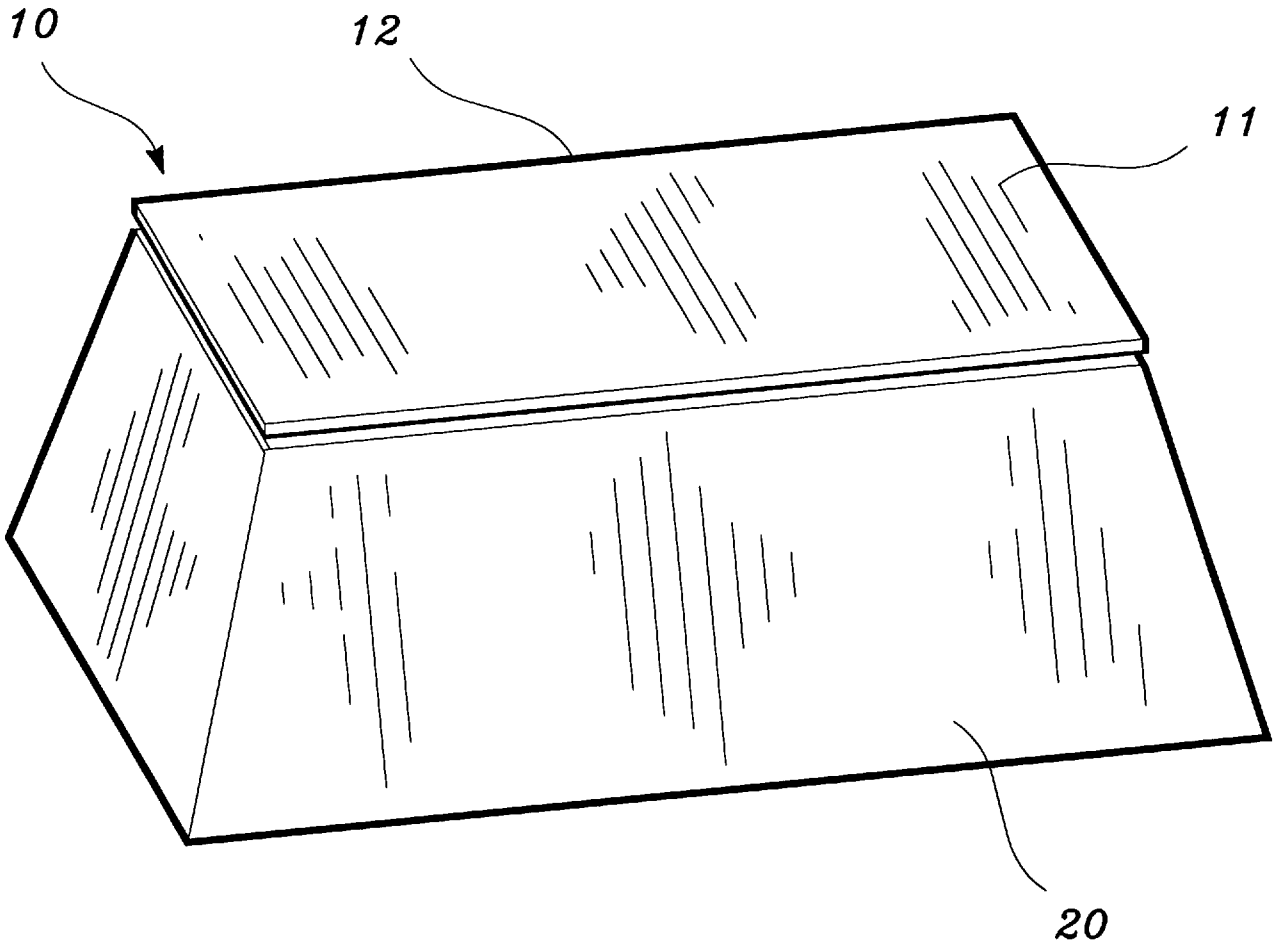
FIG. 2 is a perspective view of a preferred embodiment of the adjustable/kinetic stabilization instrument alone.
Figure 3:
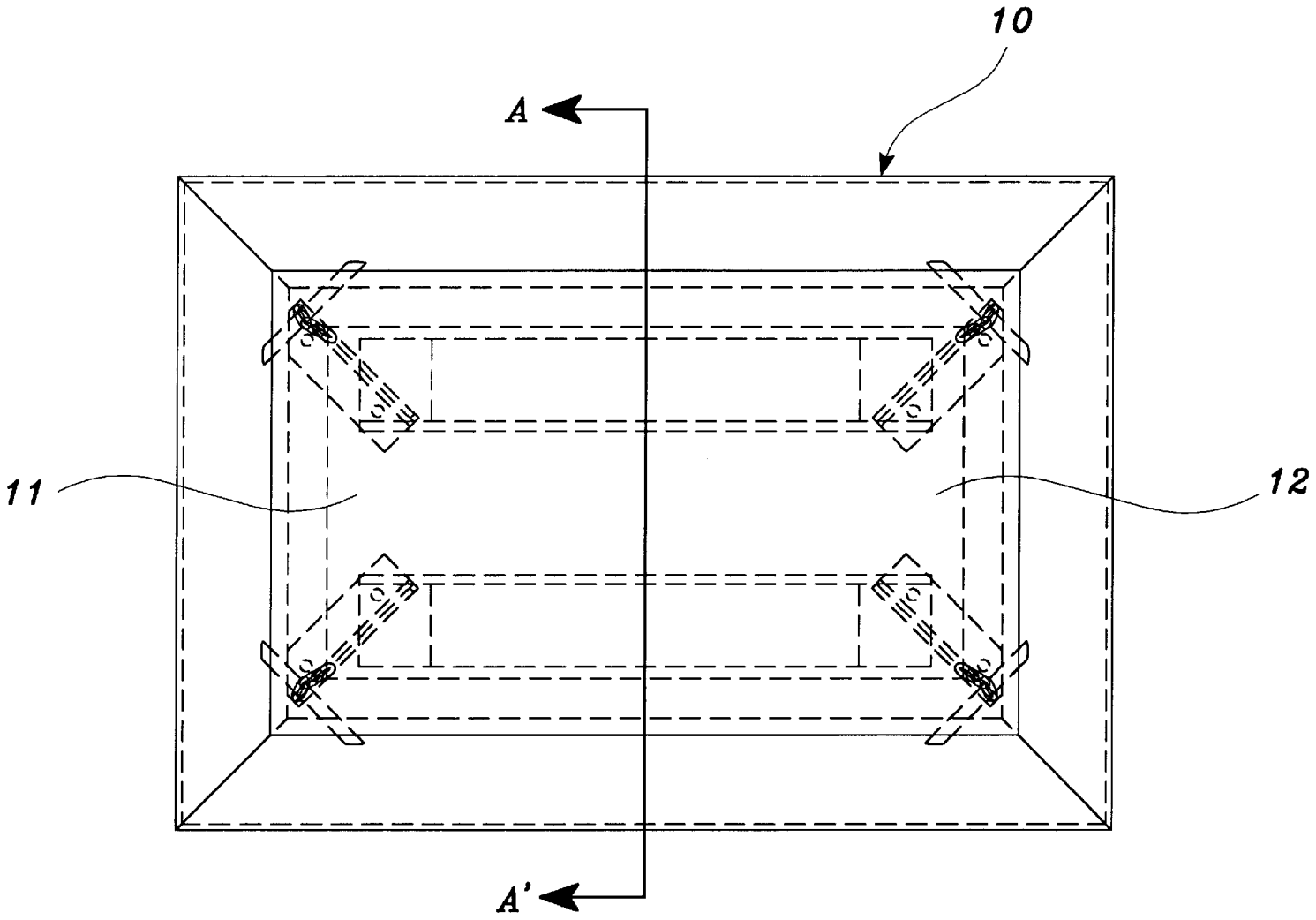
FIG. 3 is a plan view of the top portion of a preferred embodiment of the adjustable kinetic stabilization instrument
Figure 4:
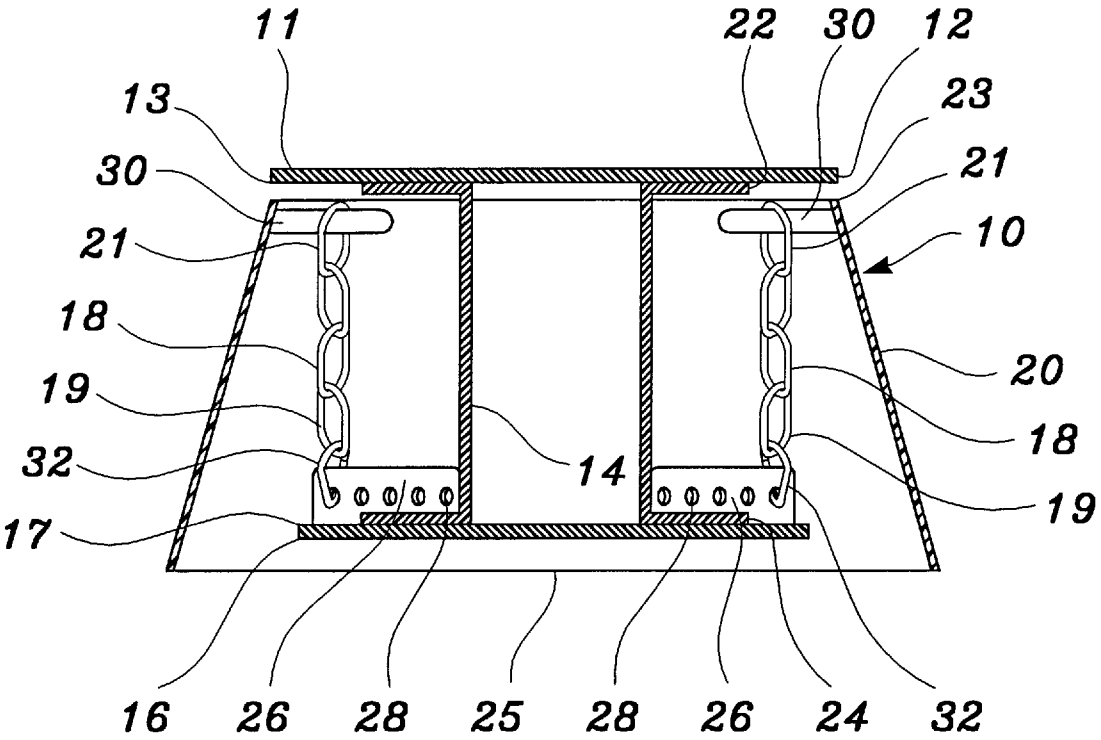
FIG. 4 is a cross-sectional view of the preferred embodiment of the adjustable kinetic stabilization instrument taken along line A–A' in FIG. 3.
Figure 5:
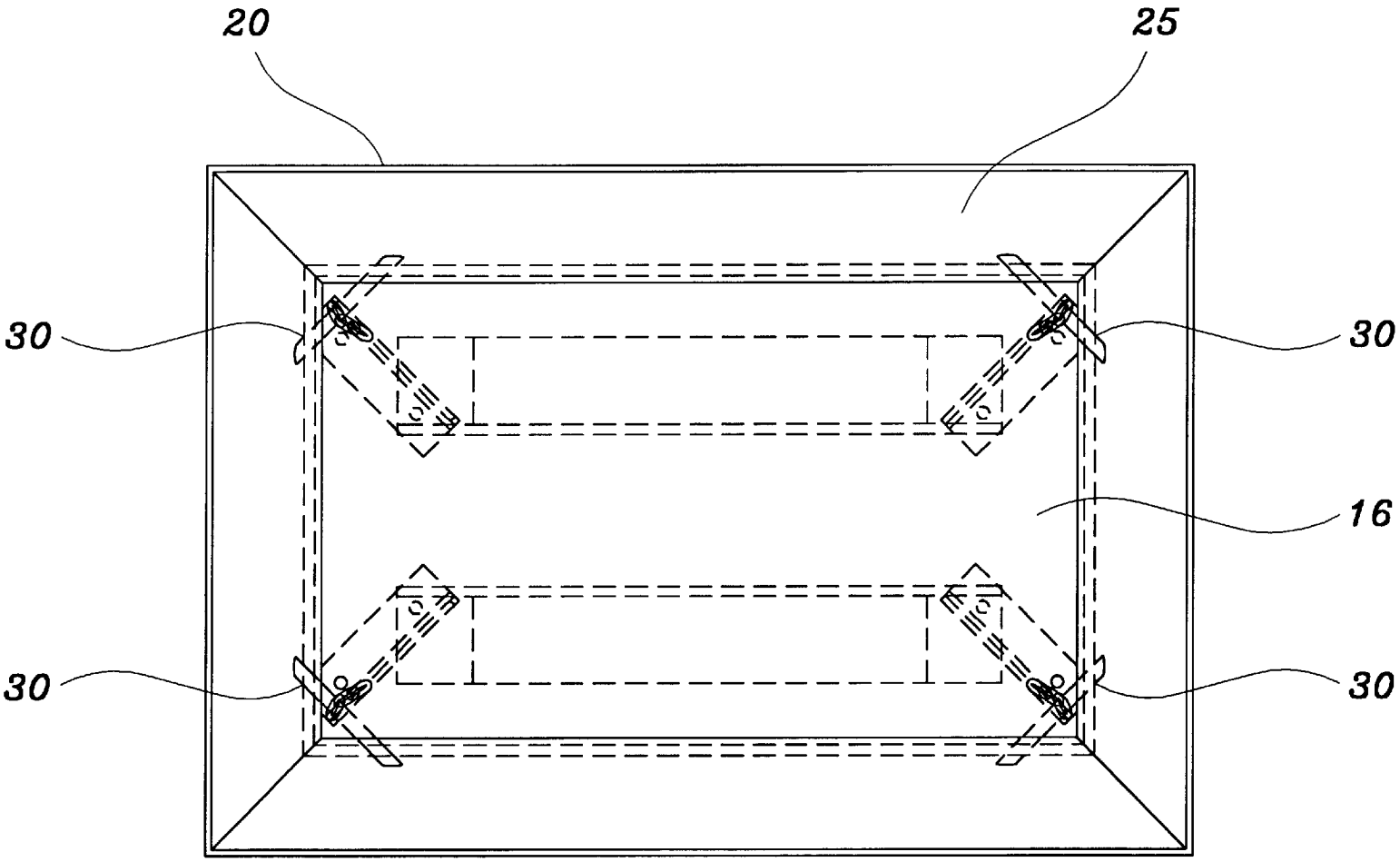
FIG. 5 is a plan view of the bottom portion of a preferred embodiment of the adjustable kinetic stabilization instrument.
Figure 6:
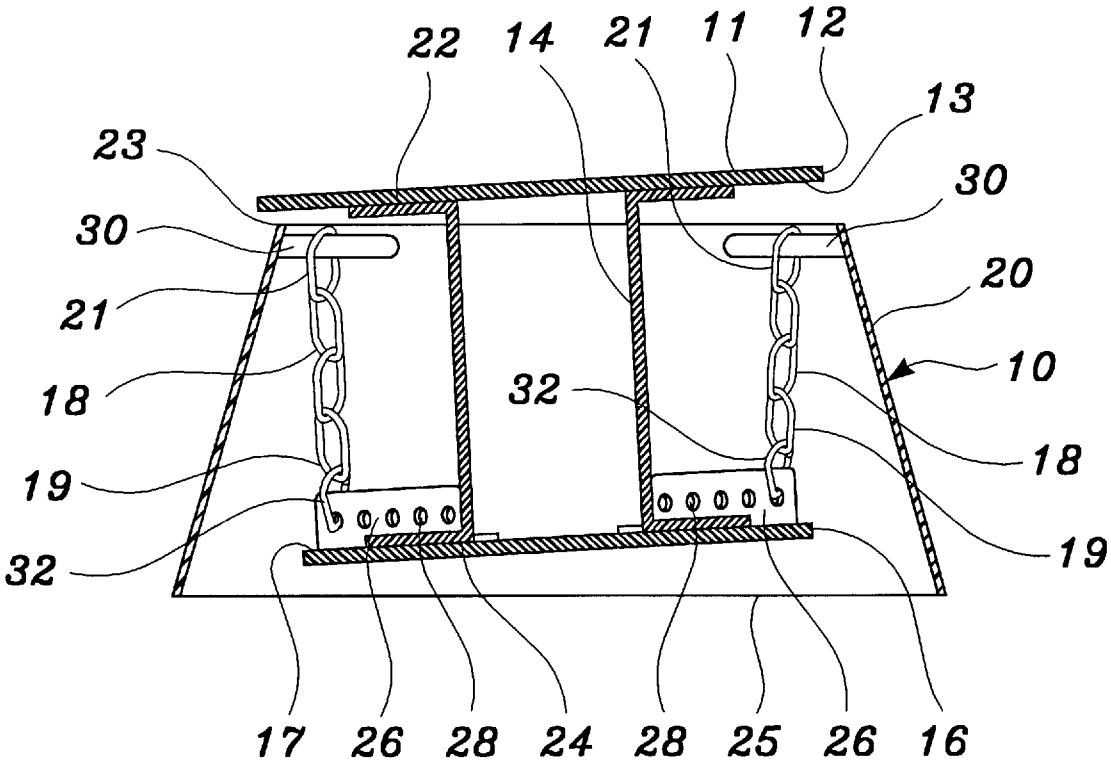
FIG. 6 is a cross-sectional view taken along line A–A' of a preferred embodiment of the adjustable kinetic stabilization instrument with the center of gravity shifted.
Figure 7:
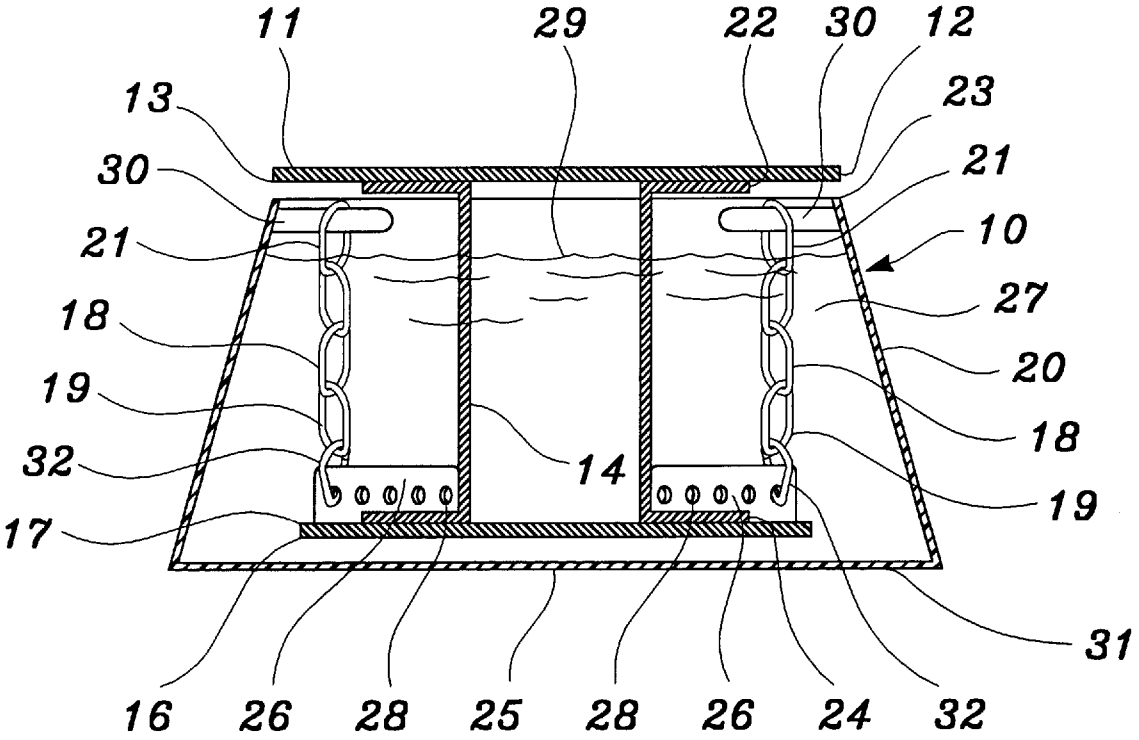
FIG. 7 is a cross-sectional view taken along line A–A' of an alternative embodiment of the adjustable kinetic stabilization instrument showing a bottom sealing material and dampening fluid in place.

Referring now to the drawings there is shown a preferred embodiment in FIGS. 1–6 of the adjustable kinetic stabilization instrument of this invention and an alternative embodiment in FIG. 7. The adjustable kinetic stabilization instrument of the present invention is particularly adapted for use by physical therapists or physical trainers to help persons develop their sense of kinesthesia. It may be used by persons with physical impairments which limit their proper sense of balance or for training gymnasts or persons who desire to improve their sense of balance, especially for competitive sporting purposes.

The drawings show the adjustable kinetic stabilization instrument 10 having a platform 12, a platform support pedestal 14, a pedestal base plate 16, a frame with sidewalls 20 and four or more pivotable pedestal supports 18. In a preferred embodiment, the platform 12 has an upper side 11 and a lower side 13. The lower side 13 is attached securely to the topside 22 of the platform support pedestal 14 with screws, bolts, pins, or by welding. In a preferred embodiment, the pedestal base plate 16 is of substantially flat shape and includes a mounting surface 17. The bottomside 24 of the platform support pedestal 14 is mounted onto the mounting surface 17 of the pedestal base plate 16, also with screws, pins, bolts or by welding. It supports the load of the pedestal 14, the platform 12 and the person using the adjustable kinetic stabilization instrument 10. In a preferred embodiment, the platform 12 and the pedestal base plate 16 are of a generally rectangular shape and preferably manufactured of a metallic material but may also be manufactured of wood, plastic, composites or any other material capable of supporting the user's weight.

In a preferred embodiment, the pedestal base plate 16 contains four or more support attachment brackets 26 which are mounted onto the surface 17 and equidistant relative to the geometric center of the pedestal base plate 16. That is, from near the corners of the base plate 16 and extending toward the center of the pedestal base plate 16. Each support attachment bracket 26 contains one or more support structure eyelets 28 which allow for rotational and linear movement adjustment of the platform 12. Adjustment is accomplished via the rotatable and removable attachment of a snap link 32, which is connected onto a first end 19 of the pivotable pedestal supports 18, in the support structure eyelets 28 of the user's choosing. This allows the user to provide a desired linear and rotational movement versus center of gravity offset relative to the geometric center of the platform. As the pedestal supports 18 are positioned closer to the geometric center of the pedestal base plate 16 via movement of the snap links 32 to other support structure eyelets 28, the linear and rotational movement of the platform 12 is increased versus the center of gravity offset of the user. This requires the user to make a much more concerted effort at maintaining his or her balance on the platform. In a preferred embodiment, the support attachment brackets 26 along with the arrangement of the support structure eyelets 28 are of a linear form but may be manufactured in curved, elliptical, hyperbolic or any other shape which will help to optimize the platform 12 rotation and movement relative to the center of gravity offset presented by the user.

The pivotable pedestal supports 18 are of a preferably metallic chain or cable type construction but may be manufactured of nylon, rope, composites, rigid pivoting arms, springs, turnbuckles or any material or structure which would allow the pedestal base plate 16 to swivel or rotate about the attachment points of each pedestal support 18 yet remain supported. Each pivotable pedestal support 18 contains a snap link 32 on a first end 19 of said support 18. The snap link 32 provides for the aforementioned adjustment within the support structure eyelets 28. Although a snap link 32 is preferred, other mechanisms such as hooks, half links, pins or bolts may be used to attach the pivotable pedestal supports 18 to the preferred support structure eyelets 28. In a preferred embodiment, each pivotable pedestal support 18 is pivotally attached on a second end 21, opposite said eyelets 28, to the frame with sidewalls 20 with frame support pins 30. In a preferred embodiment the pins 30 are removably attached and located equidistant from the geometric center of the top 22 of the frame 20 and in the topmost corners of the frame 20. In a preferred embodiment, the frame support pins 30 simply attach through a chain link, hook or eyelet at the second end 21 of each of the pivotable pedestal supports 18 upon assembly. Although pins are preferred, the function of the frame support pins 30 may be accomplished by hooks, bolts, or any other fastener which will securely hold the pivotable pedestal supports 18 and also support the weight of the user.

The frame with sidewalls 20 provides the support for the second ends 21 of the pivotable pedestal supports 18 and limits the movement of the platform 12 via contact with the platform support pedestal 14. The frame with sidewalls 20 is of a generally rectangular box-like shape with an open top 23. The platform support pedestal 14, the pedestal base plate 16 and the pivotable pedestal supports 18 fit through the open top 23 and into the frame with sidewalls 20. The frame with sidewalls 20 has a bottom 25 which may be opened or closed. In an alternative embodiment as shown in FIG. 7, the bottom 25 may be closed by placing a plate or sealing material 31 across it. In a preferred embodiment, the bottom 25 is open that the user may more easily adjust the position of the pivotable pedestal supports 18 without lifting the platform 12, the platform support pedestal 14 and the pedestal base plate 16 out of the frame with sidewalls 20.

An alternative embodiment of the current invention would have a bottom 25 on the frame with sidewalls 20 which is closed and sealed by means of a plate or sealing material 31. This would allow a dampening fluid 29 such as oil or water to be placed into the cavity 27 created by the frame with sidewalls 20. The dampening fluid 29 would allow the rate of movement of the platform 12 to be controlled via the viscosity of the dampening fluid 29. That is, as the viscosity is increased, the platform 12 would respond, both linearly and rotationally, much more slowly to a user's center of gravity offset from the geometric center of the platform 12.

This dampening effect could also be accomplished by attaching hydraulic or pneumatic dampeners to various points on the adjustable kinetic stabilization instrument 10.

In operation, the user adjusts the location of the snap links 32 by placing them in the support structure eyelets 28 which will give the desired linear and rotational movement versus center of gravity offset. (Some experimentation on the user's part is required here.) The user then places the assembled pedestal base plate 16, platform support pedestal 14, the platform 12, and the pivotable pedestal supports 18 within the frame with sidewalls 20 and stands upon the platform 12. If the user maintains his or her center of gravity aligned with the geometric center of the platform 12, the platform 12 will remain perfectly level with no rotational or linear movement. As the user shifts his or her center of gravity in a direction relative to the geometric center of the platform 12, the platform 12 will rotate and move linearly in that same direction. This forces the user to move his or her center of gravity opposite the direction of linear and rotational movement in order to maintain the platform 12 in a level position. This movement forces the user to concentrate on his or her balancing skills, thereby honing the user's ability to balance while off the platform or while participating in sporting activities. Should the user lose his or her balance while standing on the platform 12, the linear movement and angle of rotation will be limited by the platform support pedestal 14 coming to rest upon the frame with sidewalls 20.

Further adjustment of the snap links 32 may be required as the user hones his or her balancing ability. That is, as the user increases his or her balancing ability, the snap links 32 may need to be moved to support structure eyelets 28 which are closer to the geometric center of the pedestal base plate 16. This provides a more pronounced rotational and linear movement of the platform 12 versus user center of gravity offset since the user's center of gravity is closer to the pivoting points where the snap links 32 are attached to the support structure eyelets 28. As the first ends 19 of the pivotable pedestal supports 18 are mounted closer to the geometric center of the platform support pedestal 14, the moment arm provided by each pivotable pedestal support 18 is decreased, thereby allowing for a more pronounced rotational and linear movement versus user center of gravity offset. This allows the user to develop his or her balancing abilities even further.

From the foregoing description those skilled in the art will appreciate that all objects of the present invention are realized. An adjustable kinetic stabilization instrument has been shown and described which permits a user to progressively develop and improve his or her balancing abilities. The device of this invention is able to withstand the weight of a human being and provide an adjustable linear and rotational movement versus user's center of gravity offset. The present invention, in an alternate embodiment, provides for dampening of the linear and rotational movement presented to the user by means of a dampening fluid 29 placed within the cavity 27 of the frame with sidewalls 20.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. An adjustable kinetic stabilization instrument for improving a person's sense of kinesthesia, comprising:

a platform of substantially flat shape, having an upper side and a lower side; and a platform support pedestal, having a topside and a bottomside, said topside mounted onto said lower side of said platform; and a pedestal base plate of substantially flat shape and having a mounting surface, said mounting surface of said pedestal base plate mounted onto said bottomside of said platform support pedestal, said pedestal base plate having four or more support attachment brackets mounted onto said pedestal base plate substantially equidistant from the geometric center of said pedestal base plate; and said four or more support attachment brackets each having one or more support structure eyelets; and a frame with sidewalls, having a bottom, a top and four or more frame support pins removably attached substantially equidistant from the geometric center of said top of said frame with sidewalls and near said top; and four or more pivotable pedestal supports each having a first end and a second end, said second end pivotally attached to a distinct said frame support pin and each of said first ends having an attached snap link; and each of said snap links removably and pivotally attached to a distinct said support attachment bracket through said one or more support structure eyelets, whereby rotation and linear movement of said platform may occur as the center of gravity is shifted away from the geometric center of said platform.

2. The adjustable kinetic stabilization instrument as set forth in claim 1 whereby:

said pivotable pedestal supports comprise chains.

3. The adjustable kinetic stabilization instrument as set forth in claim 1 whereby:

said pivotable pedestal supports comprise cables.

4. The adjustable kinetic stabilization instrument as set forth in claim 1 further comprising:

a sealing material placed onto and across said bottom of said frame with sidewalls, thereby forming a cavity within said frame with sidewalls; and a dampening fluid placed into said cavity thereby helping to dampen the linear and rotational movement of said platform.

5. An adjustable kinetic stabilization instrument for improving a person's sense of kinesthesia, comprising:

a platform of substantially flat shape, having an upper side and a lower side; and a platform support pedestal, having a topside and a bottomside, said topside mounted onto said lower side of said platform; and a pedestal base plate having a mounting surface, said mounting surface of said pedestal base plate mounted onto said bottomside of said platform support pedestal, said pedestal base plate having four or more support attachment brackets mounted onto said pedestal base plate substantially equidistant from the geometric center of said pedestal base plate; and four or more pivotable pedestal supports each having a first end and a second end, said first end having means to removably attach said pivotable pedestal support to a distinct said support attachment bracket and;

said four or more support attachment brackets each having means for removably and adjustably attaching said first end of said pivotable pedestal support; and a frame with sidewalls, having a bottom, a top and means for attaching to said second ends of said pivotable pedestal supports, substantially equidistant from the geometric center of said top of said frame with sidewalls and near said top, whereby rotation and linear movement of said platform may occur when the center of gravity of said platform is shifted from its geometric center.

6. The adjustable kinetic stabilization instrument as set forth in claim 5 further comprising:

a means for dampening the linear and rotational movement of said platform.

7. An adjustable kinetic stabilization instrument for improving a person's sense of kinesthesia, comprising:

a platform of substantially flat shape, having an upper side and a lower side; and a platform support pedestal, having a topside and a bottomside, said topside mounted onto said lower side of said platform; and a pedestal base plate of substantially flat shape and having a mounting surface, said mounting surface of said pedestal base plate mounted onto said bottomside of said platform support pedestal, said pedestal base plate having four or more support attachment brackets mounted onto said pedestal base plate substantially equidistant from the geometric center of said pedestal base plate; and said four or more support attachment brackets each having a plurality of support structure eyelets; and a frame with sidewalls, having a bottom, a top and four or more frame support pins removably attached substantially equidistant from the geometric center of said top of said frame with sidewalls and near said top; and four or more pivotable pedestal supports each having a first end and a second end, said second end pivotally attached to a distinct said frame support pin and each of said first ends having a means for removably and pivotally attaching to one of said plurality of eyelets; and each of said first ends of said pivotable pedestal supports, attached via said means for removably and pivotally attaching, to a distinct said support attachment bracket through one of said plurality of support structure eyelets, whereby rotation and linear movement of said platform may occur as the center of gravity is shifted away from the geometric center of said platform and said movement is adjustable by moving said first ends of said pivotable pedestal supports to another of said plurality of support structure eyelets.

8. The adjustable kinetic stabilization instrument as set forth in claim 7 further comprising:

a sealing material placed onto and across said bottom of said frame with sidewalls, thereby forming a cavity within said frame with sidewalls; and a dampening fluid placed into said cavity thereby helping to dampen the linear and rotational movement of said platform.

* * * * *